US011631355B2

(12) United States Patent
Park et al.

(10) Patent No.: US 11,631,355 B2
(45) Date of Patent: Apr. 18, 2023

(54) DISPLAY SYSTEM AND DISPLAY DEVICE

(71) Applicant: SAMSUNG DISPLAY CO., LTD., Yongin-si (KR)

(72) Inventors: Se Hyuk Park, Yongin-si (KR); Jin Young Roh, Yongin-si (KR); Hyo Jin Lee, Yongin-si (KR); Jae Keun Lim, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/521,066

(22) Filed: Nov. 8, 2021

(65) Prior Publication Data

US 2022/0293027 A1 Sep. 15, 2022

(30) Foreign Application Priority Data

Mar. 15, 2021 (KR) ..... 10-2021-0033635

(51) Int. Cl.
*G09G 3/20* (2006.01)

(52) U.S. Cl.
CPC ..... *G09G 3/20* (2013.01); *G09G 2310/0213* (2013.01); *G09G 2310/0267* (2013.01); *G09G 2310/0275* (2013.01); *G09G 2330/021* (2013.01); *G09G 2370/04* (2013.01)

(58) Field of Classification Search
CPC ..... G09G 3/20; G09G 2310/0213; G09G 2310/0267; G09G 2310/0275; G09G 2330/027; G09G 2330/021
See application file for complete search history.

(56) References Cited

U.S. PATENT DOCUMENTS

| | | | | |
|---|---|---|---|---|
| 9,672,792 | B2 | 6/2017 | Choi et al. | |
| 10,123,022 | B2 | 11/2018 | Kaya et al. | |
| 10,672,353 | B2 | 6/2020 | Kim et al. | |
| 10,916,218 | B2 | 2/2021 | Kim et al. | |
| 2007/0110405 | A1* | 5/2007 | Kondo | H04N 21/4334 375/E7.021 |
| 2007/0279363 | A1 | 12/2007 | Maeng et al. | |

(Continued)

FOREIGN PATENT DOCUMENTS

| | | | |
|---|---|---|---|
| KR | 1020070115371 | A | 12/2007 |
| KR | 1020160005661 | A | 1/2016 |
| KR | 1020180003402 | A | 1/2018 |

(Continued)

*Primary Examiner* — Gerald Johnson
(74) *Attorney, Agent, or Firm* — Cantor Colburn LLP

(57) ABSTRACT

A display system includes: a host processor which outputs first image data and outputs scan frequency information and a partial scan enable signal, based on an image driving frequency; a display module controlled by the host processor; and an interface. The display module includes: a display driving circuit which controls a selection of pixel rows to which the data signals are supplied based on the scan frequency information and the partial scan enable signal; and a display panel which displays an image on selected pixel rows based on the data signals. In a video mode of the interface, the host processor divides and outputs the first image data through the interface during transmission periods, based on the image driving frequency, and suspends an output of the first image data through the interface during suspend periods.

19 Claims, 9 Drawing Sheets

(56) References Cited

U.S. PATENT DOCUMENTS

| | | | | |
|---|---|---|---|---|
| 2013/0278572 | A1 | 10/2013 | Lee et al. | |
| 2019/0237021 | A1* | 8/2019 | Peng | G09G 5/391 |

FOREIGN PATENT DOCUMENTS

| | | | |
|---|---|---|---|
| KR | 1020180025438 | A | 3/2018 |
| KR | 101954934 | B1 | 3/2019 |
| KR | 102070660 | B1 | 1/2020 |

* cited by examiner

VIDEO MODE(VM)

VIDEO MODE(VM)

COMMAND MODE (CM)

DISPLAY SYSTEM AND DISPLAY DEVICE

The application claims priority to Korean patent application 10-2021-0033635, filed on Mar. 15, 2021, and all the benefits accruing therefrom under 35 U.S.C. § 119, the content of which in its entirety is herein incorporated by reference.

BACKGROUND

1. Field

The disclosure generally relates to an electronic device including a system, and more particularly, to a display system including a display driving circuit and a host processor.

2. Description of the Related Art

Electronic devices having an image display function, such as computers, tablet personal computers ("PC"s), smartphones, and wearable electronic devices, include a display system.

As performance of displays, image sensors, and the like, which are included in electronic devices such as mobile devices, is improved and resolution thereof is increased, the amount of transmission data has been rapidly increased. Studies on serial interfaces have been actively conducted to support high-resolution images of nHD (360×640) or higher.

In such electronic devices, an image, such as a still image, may be displayed at a low frequency of less than 60 hertz (Hz) to reduce power consumption. Accordingly, research for minimizing degradation of image quality in low frequency driving while reducing power consumption by changing a driving frequency based on a characteristic of an image has been conducted.

SUMMARY

Embodiments provide a display system in which, in partial scan driving in a video mode of a display serial interface, image data is divided and transmitted to the display serial interface during transmission periods, and the transmission of the image data to the display serial interface is suspended during suspend periods between the transmission periods.

In accordance with an embodiment of the disclosure, a display system includes: a host processor which outputs first image data obtained by rearranging an output order of input image data, based on an image driving frequency, and outputs scan frequency information and a partial scan enable signal; a display module controlled by the host processor; and an interface through which data transmission/reception between the host processor and the display module is performed. In such an embodiment, the display module includes: a display driving circuit which generates data signals corresponding to the first image data, and controls a selection of pixel rows to which the data signals are supplied, based on the scan frequency information and the partial scan enable signal; and a display panel including pixels, where the display panel displays an image on selected pixel rows, based on the data signals. In such an embodiment, in a video mode of the interface, the host processor divides and outputs the first image data through the interface during transmission periods, based on the image driving frequency, and suspends an output of the first image data through the interface during suspend periods.

In an embodiment, the display driving circuit may include: a partial scan controller activated in response to the partial scan enable signal, where the partial scan controller may generate a scan control signal and a data control signal, based on the scan frequency information; a scan driver which supplies a scan signal for data writing to corresponding pixel rows during each of write periods of one frame and suspends a supply of the scan signal during power saving periods of the one frame, based on the scan control signal; and a data driver which converts the first image data into the data signals, and supplies the data signals to data lines during the write periods.

In an embodiment, the data driver may suspend the output of the data signals during the power saving periods.

In an embodiment, the display driving circuit may further include a power supply which generates power sources supplied to the scan driver and the data driver. In such an embodiment, the power supply may suspend a supply of at least one selected from the power sources during the power saving periods, based on the scan frequency information.

In an embodiment, the transmission periods corresponding to an image of the one frame may include first to k-th transmission periods, and the suspend periods corresponding to an image of the one frame may include first to k-th suspend periods respectively adjacent to the first to k-th transmission periods, where k may be an integer greater than 1. In such an embodiment, the host processor may determine a value of k, based on the image driving frequency.

In an embodiment, the write periods may include first to k-th write periods respectively corresponding to the first to k-th transmission periods, and the power saving periods may include first to k-th power saving periods respectively corresponding to the first to k-th suspend periods.

In an embodiment, the scan driver may supply the scan signal to different pixel rows in the first to k-th write periods.

In an embodiment, a number of repetitions of the write period and the power saving period in the one frame may increase as the image driving frequency decreases.

In an embodiment, as the image driving frequency decreases, a length of each of the first to k-th write periods may decrease, and a length of each of the first to k-th power saving periods may increase.

In an embodiment, as the image driving frequency decreases, a length of each of the first to k-th transmission periods may decrease, and a length of each of the first to k-th suspend periods may increase.

In an embodiment, the host processor may divide the first image data corresponding to the image of the one frame into k data groups and output the k data groups to the interface in the first to k-th transmission periods, respectively.

In an embodiment, when the image driving frequency is lower than a reference frequency, the host processor may output the partial scan enable signal.

In an embodiment, the image driving frequency may be lower than the reference frequency in the video mode.

In an embodiment, in a partial scan activation period in which the partial scan enable signal of a command mode of the interface is activated, the host processor may rearrange, as the first image data, the input image data of a first frame at a start timing of the partial scan activation period, divide and output the first image data through the interface during transmission periods of the first frame, based on the image driving frequency, and suspend the output of the first image data through the interface during suspend periods of the first frame.

In an embodiment, the display module may further include a memory which stores the first image data in the command mode.

In an embodiment, in the partial scan activation period of the command mode, the partial scan controller may load a portion of the first image data from the memory for every write period of subsequent frames of the first frame and then provide the portion of the first image data to the data driver.

In an embodiment, the host processor may suspend the output of image data corresponding to the subsequent frames in the partial scan activation period.

In an embodiment, the display module may further include a frequency determiner which determines an image driving frequency, based on the input image data, and provides information of the image driving frequency to the host processor through the interface.

In an embodiment, the interface may include a display serial interface. In such an embodiment, the display serial interface may include: a first channel which transfers the scan frequency information to the display driving circuit; and a second cannel which transfers the partial scan enable signal for activating the partial scan controller to the display driving circuit.

In accordance with an embodiment of the disclosure, a display device includes: an interface which receives divided image data of one frame from an external device during transmission periods apart from each other in time, based on an image driving frequency in a video mode; a display driving circuit which generates data signals corresponding to the divided image data, and control a selection of pixel rows to which the data signals are supplied, based on scan frequency information and a partial scan enable signal; and a display panel including pixels, where the display panel displays an image on selected pixel rows, based on the data signals. In such an embodiment, the display driving circuit includes: a partial scan controller activated in response to the partial scan enable signal, where the partial scan controller generates a scan control signal and a data control signal, based on the scan frequency information; a scan driver which supplies a scan signal for data writing to corresponding pixel rows during each of write periods of the one frame and suspends a supply of the scan signal during power saving periods of the one frame, based on the scan control signal; and a data driver which converts the divided image data into the data signals, supplies the data signals to data lines during the write periods, and suspends an output of the data signals during the power saving periods.

BRIEF DESCRIPTION OF THE DRAWINGS

The above and other features of the invention will become more apparent by describing in further detail embodiments thereof with reference to the accompanying drawings, in which.

DETAILED DESCRIPTION

Figure 1:
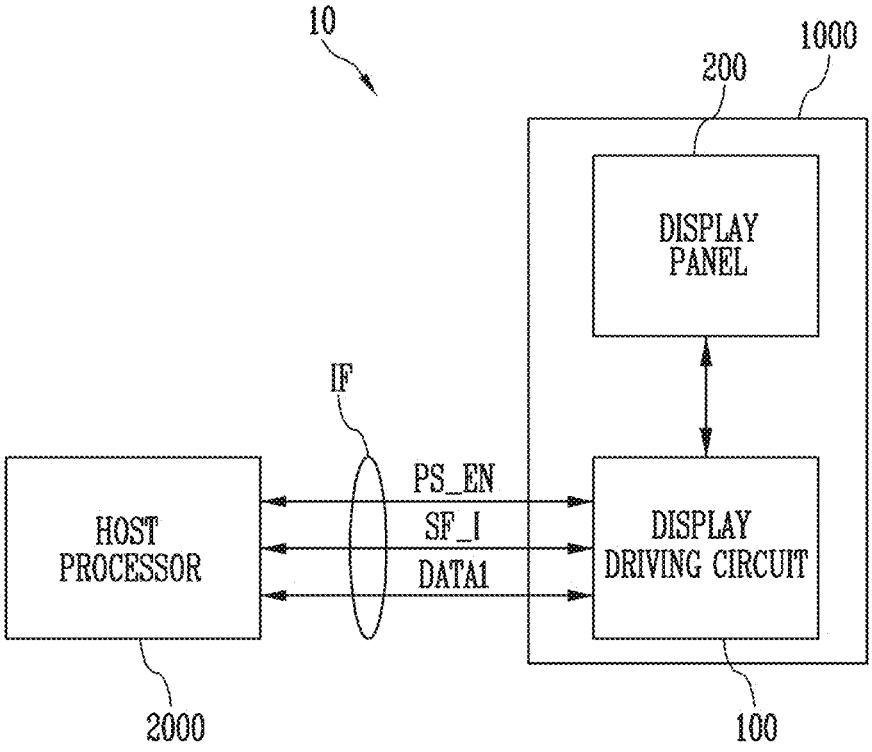
FIG. 1 is a block diagram illustrating a display system in accordance with an embodiment of the disclosure.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10% or 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, embodiments of the disclosure will be described in detail with reference to the accompanying drawings.

FIG. 1 is a block diagram illustrating a display system in accordance with an embodiment of the disclosure.

Referring to FIG. 1, an embodiment of the display system 10 may include a display module 1000, a host processor 2000, and an interface IF through which data reception/transmission between the display module 1000 and the host processor 2000 is performed.

In an embodiment, the display system 10 may further include a nonvolatile memory, an additional storage device, an input/output device, a power management device, a communication module, a camera module, a sensor module, and the like.

In an embodiment, the display system 10 may be implemented as a device which may use or support a Mobile Industry Processor Interface ("MIPI") interface, e.g., a mobile device such as a mobile phone, a personal digital assistant ("PDA"), a portable media player ("PMP"), a smartphone, or a wearable device.

The host processor 2000 may control overall operations of the display module 1000. In one embodiment, for example, the host processor 2000 may be implemented as a system-on-chip ("SoC"), and be an application processor ("AP") provided in a mobile device.

The host processor 2000 may transmit/receive data to/from the display module 1000, e.g., a display driving circuit 100 included in the display module 1000, through the interface IF. In an embodiment, the interface IF may be a display serial interface ("DSI"). In one embodiment, for example, the interface IF may correspond to the MIPI, and conform with MIPI alliance specification for display serial interface and MIPI alliance specification for D-PHY. However, this is merely illustrative, and a communication interface between the host processor 2000 and the display driving circuit 100 is not limited thereto. In one alternative embodiment, for example, the MIPI alliance specification for display serial interface, etc. may be partially modified to perform data transmission/reception. Alternatively, the interface IF may be configured as one of various serial high-speed interfaces which support a high-quality image of n-High Definition ("nHD") or higher.

The host processor 2000 may generate input image data to be provided to the display module 1000, based on an external input, etc. The host processor 2000 may rearrange an output order of the input image data, based on an image driving frequency. The rearranged input image data may be provided as first image data DATA1 to the display driving circuit 100 through the interface IF.

The image driving frequency may be the number of repetitions of an image frame for 1 second. The image driving frequency may be determined at the inside of the host processor 2000 by an external input, or be determined in the display driving circuit 100. In an embodiment, where the image driving frequency is determined in the display driving circuit 100, information associated with the image driving frequency may be provided to the host processor 2000 through the interface IF.

In an embodiment, when the image driving frequency is lower than a predetermined reference frequency, the host processor 2000 may rearrange the input image data as the first image data DATA. In one embodiment, for example, the reference frequency may be set as 60 hertz (Hz) as a frequency at which a normal moving image is displayed. In such an embodiment, when an image is displayed by driving at a frequency lower than 60 Hz, the input image data may be rearranged as the first image data DATA1. The first image data DATA1 may be divided into a plurality of data groups, and each of the data groups may be sequentially output at a predetermined time interval.

In an embodiment, in driving at a frequency less than the reference frequency, a still image, an always-on-display ("AOD") image, or the like may be displayed.

When the image driving frequency is the reference frequency or higher, the host processor 2000 may serially output the input image data through the interface IF.

The host processor 2000 may output scan frequency information SF_I and a partial scan enable signal PS_EN, based on the image driving frequency. The scan frequency information SF_I may include information on an output frequency of a scan signal for data writing for each pixel row, corresponding to the image driving frequency. In one embodiment, for example, pixel rows (scan lines for data writing) selected in each of write periods may be determined based on the scan frequency information SF_I.

The partial scan enable signal PS_EN may include a command for activating partial scan driving of the display module 1000.

The partial scan driving may be activated for driving at a frequency lower than the reference frequency. In the partial scan driving, all pixel rows may be scanned in a way such that a scan signal for data writing is applied to some pixel rows which are periodically different from each other in one frame. In low frequency driving for low power consumption, the partial scan driving is a technique for minimizing a side effect such as an image flicker caused by leakage of driving current in a pixel, etc.

In an embodiment, when the image driving frequency is lower than the reference frequency, the host processor 2000 may output the partial scan enable signal PS_EN. When the image driving frequency is the reference frequency or higher, the partial scan enable signal PS_EN is not output or may have a turn-off level.

The display module 1000 may include the display driving circuit 100 and a display panel 200.

In an embodiment, the display driving circuit 100 may generate data signals corresponding to the first image data DATA1 based on the scan frequency information SF_I and the partial scan enable signal PS_EN. The data signals may be provided to the display panel 200. In such an embodiment, the display driving circuit 100 may control selection of pixel rows to which the data signals are supplied based on the scan frequency information SF_I and the partial scan enable signal PS_EN. In such an embodiment, the display driving circuit 100 may control the partial scan driving based on the scan frequency information SF_I and the partial scan enable signal PS_EN.

When the scan enable signal PS_EN is not activated, the display driving circuit 100 may convert the input image data into data signals in an appropriate format, and provide the data signals to the display panel 200.

The display panel 200 may include a plurality of pixels, and display an image corresponding to the supplied data signals.

The interface IF may be in a video mode and a command mode.

In the command mode, the display module 1000 may autonomously refresh an image by using a separate memory (e.g., a frame memory, etc.) included in the display module 1000. In one embodiment, for example, image data supplied from the host processor 2000 may be stored in the memory of the display module 1000, and the display module 1000 may display an image by loading the image data from the memory.

In the video mode, the host processor 2000 may directly control the image of the display module 1000. In one embodiment, for example, in the video mode, the image of the display module 1000 may be controlled in real time by the image data supplied from the host processor 2000. In the video mode, any separate memory for storing image data or frame data may not be used.

In an embodiment, in the video mode of the interface IF, the host processor 2000 may distribute (or divide) the first image data DATA1 during transmission periods (or image transmission periods), based on the image driving frequency, and then output the distributed image data. The host processor 2000 may suspend the output of the first image data DATA1 during suspend periods (or image transmission suspend periods), based on the image driving frequency. The number of the transmission periods and the number of the suspend periods may be set corresponding to one frame. In an embodiment, the transmission periods and the suspend periods may be alternately provided with each other.

In the suspend periods, data transmission to lanes for transmitting image data of the interface IF may be suspended, and a power and signal providing element associated with the data transmission to the corresponding lanes may be turned off.

Figure 2:
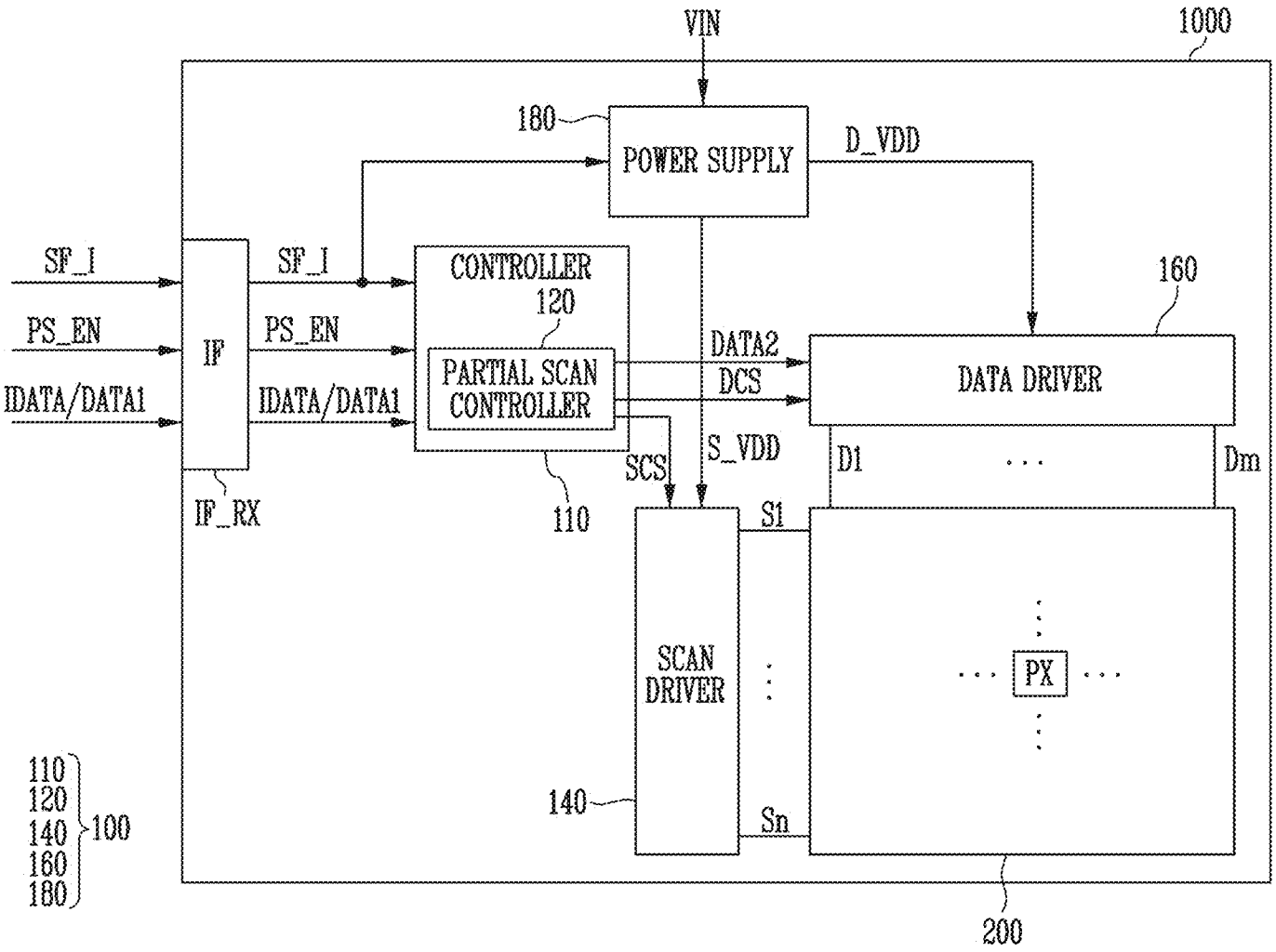
FIG. 2 is a block diagram illustrating an embodiment of a display module included in the display system shown in FIG. 1.

FIG. 2 is a block diagram illustrating an embodiment of the display module included in the display system shown in FIG. 1.

Referring to FIGS. 1 and 2, an embodiment of a display module 1000 (or a display device) may include a display driving circuit 100 and a display panel 200.

In an embodiment, the display module 1000 may include a flat panel display device, a flexible display device, a curved display device, a foldable display device, a bendable display device, or a stretchable display device. In an embodiment, the display module 1000 may include a transparent display device, a head-mounted device, a wearable device, or the like.

The display panel 200 may include scan lines S1 to Sn (n is an integer greater than 1), data lines D1 to Dm (m is an integer greater than 1), and pixels PX. The pixels PX may be electrically connected to the data lines D1 to Dm and the scan lines S1 to Sn. Pixels (or a pixel line) which is simultaneously controlled by one scan line to be substantially simultaneously supplied with data signals may be referred to as one pixel row. In one embodiment, for example, pixels which receive a data signal, based on a scan signal supplied to a first scan line S1, may be referred to as a first pixel row.

In an embodiment, at least one scan line may be connected to each of the pixels PX. Although not shown in the drawing, the pixels PX may also be connected to additional emission control lines.

The pixels PX may emit light with a grayscale and a luminance, which correspond to a data signal supplied from the data lines D1 to Dm. Each of the pixels PX may include a driving transistor and at least one switching transistor.

In an embodiment, the display module 1000 (or a display device) may include a reception interface IF_RX of an interface IF. In one embodiment, for example, the reception interface IF_RX may be included in a controller 110. The display module 1000 may receive scan frequency information SF_I, a partial scan enable signal PS_EN, and image data IDATA/DATA1, which are supplied from the host processor 2000, through the reception interface IF_RX.

In an embodiment, the display driving circuit 100 may include a partial scan controller 120, a scan driver 140, and a data driver 160. The display driving circuit 100 may further include a power supply 180.

The controller 110 may serve as a timing controller. In an embodiment, the controller 110 may generate a scan control signal SCS and a data control signal DCS, based on clock signals and control signals, which are supplied from an outside. The scan control signal SCS may be supplied to the scan driver 140, and the data control signal DCS may be supplied to the data driver 160. In such an embodiment, the controller 110 may realign image data IDATA/DATA1 supplied from the outside and then supply the realigned image data to the data driver.

A scan start pulse and scan clock signals may be included in the scan control signal SCS. The scan start pulse may control a start timing of a scan signal. The scan clock signals may be used to shift the scan start pulse.

A source start pulse and data clock signals may be included in the data control signal DCS. The source start pulse controls a sampling start time of the realigned image data. The data clock signals are used to control a sampling operation.

In an embodiment, the partial scan controller 120 may be included in the controller 110. In an embodiment, as shown in FIG. 2, the partial scan controller 120 may be a component in the controller 110, but this is merely illustrative, and at least a portion of a function or physical configuration of the partial scan controller 120 may be provided separately from the controller 110.

In an embodiment of the disclosure, the partial scan controller 120 may control driving of the scan driver 140 and the data driver 160 for partial scan driving. In one embodiment, for example, the partial scan controller 120 may be activated by the partial scan enable signal PS_EN to control, together with another component of the controller 110, the driving of the scan driver 140 and the data driver 160. When the partial scan enable signal PS_EN is not supplied, another component of the controller 110 except the partial scan controller 120 may control the driving of the scan driver 140 and the data driver 160.

In an embodiment, the partial scan controller 120 may generate the scan control signal SCS and the data control signal DCS, based on scan frequency information SF_1. In such an embodiment, the partial scan controller 120 may realign first image data DATA1 in a format suitable for an operation of the data driver 160 and then generate second image data DATA2.

The scan driver 140 may supply a scan signal to the scan lines S1 to Sn, based on the scan control signal SCS. In one embodiment, for example, the scan driver 140 may sequentially supply the scan signal to the scan lines S1 to Sm. When the scan signal is sequentially supplied, the pixels PX may be selected in units of horizontal lines (or units of pixel rows).

In an embodiment, the scan driver 140 controlled by the partial scan controller 120 may supply a scan signal for data writing to some pixel rows during write periods of one frame, and suspend the supply of the scan signal during power saving periods in the one frame. In one embodiment, for example, where the one frame includes a first write period, a first power saving period, a second write period and a second power saving period, the scan driver 140 may sequentially supply the scan signal to scan lines connected to odd-numbered pixel rows in the first write period, and sequentially supply the scan signal to scan lines connected to even-numbered pixel rows in the second write period.

In an embodiment, as described above, different pixel rows are selected in the write periods, so that data writing may be performed.

In an embodiment, the controller 110 and the partial scan controller 120 may not generate signals for driving of the scan driver 140, such as the scan control signal SCS, in the power saving periods.

In an embodiment, in the video mode, the write periods may respectively correspond to the transmission periods, and the power saving periods may respectively correspond to the suspend periods.

The data driver 160 may receive the data control signal DCS and the second image data DATA2. The data driver 160 may supply, to the data lines D1 to Dm, analog data signals obtained by converting the second image data DATA2, corresponding to the data control signal DCS. The data signal supplied to the data lines D1 to Dm may be supplied to selected pixels PX by the scan signal. In such an embodiment, the data driver 160 may supply the data signal to the data lines D1 to Dm to be synchronized with the scan signal.

In an embodiment, the data driver 160 controlled by the partial scan controller 120 may supply data signals to the data lines during the write periods. The data driver 160 may suspend the output of the data signals during the suspend periods.

In an embodiment, the controller 110 and the partial scan controller 120 may not generate signals for driving of the data driver 160, such as the data control signal DCS, in the power saving periods.

In an embodiment, at least some functions of the data driver 160 and the controller 110 may be integrated at a single driving circuit. In one embodiment, for example, the driving circuit may be provided in the form of an integrated circuit ("IC") which performs the functions of the data driver 160 and the controller 110.

The power supply 180 may generate first power sources S_VDD for driving the scan driver 140 and second power sources D_VDD for driving the data driver 160, based on an input power source VIN supplied from the outside. In one embodiment, for example, the first power sources S_VDD may include a high potential power source and a low potential power source, based on which the scan signal is generated. The second power sources D_VDD may include a power source for generating a data signal, a reference power source for generating grayscale voltages, and the like.

In an embodiment, the power supply 180 may suspend the supply of at least one selected from the first power sources S_VDD and the second power sources D_VDD during the power saving periods, based on the scan frequency information SF_1. Accordingly, the driving of the scan driver 140 and the data driver 160 may be suspended in the power saving periods.

The power supply 180 may further generate power sources for driving of the pixel PX and provide the generated power sources to the display panel 200.

Figure 3:
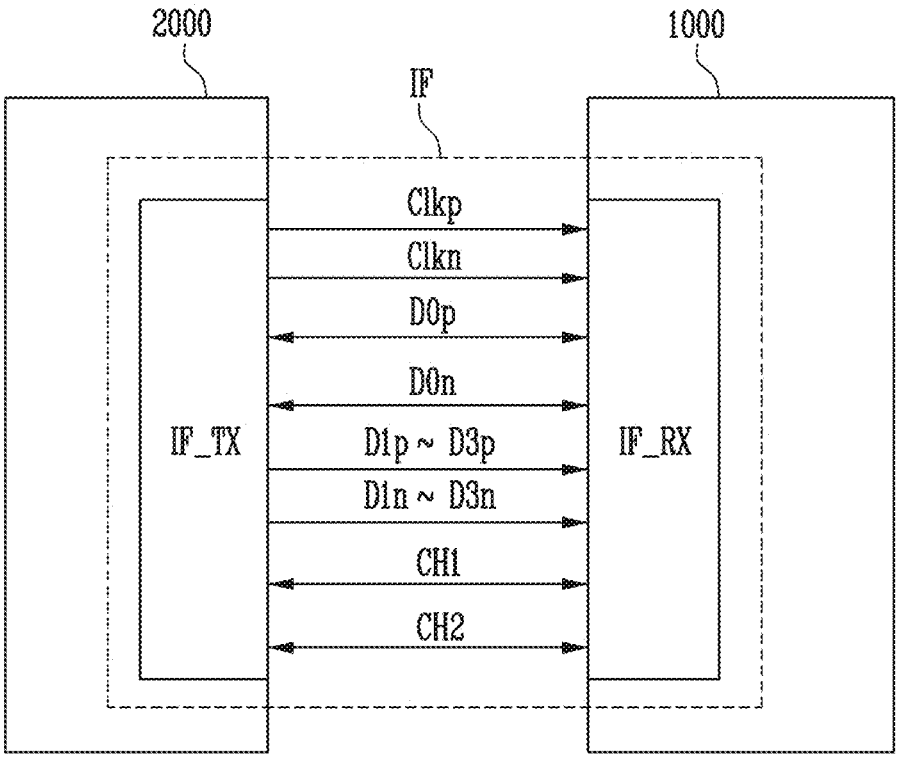
FIG. 3 is a block diagram illustrating an embodiment of an interface included in the display system shown in FIG. 1.

FIG. 3 is a diagram illustrating an embodiment of the interface included in the display system shown in FIG. 1.

Referring to FIGS. 1, 2, and 3, data transmission between the host processor 2000 and the display module 1000 may be performed through an interface IF.

In an embodiment, the interface IF may include a DSI. In one embodiment, for example, the interface IF may be an MIPI. The interface may conform with MIPI alliance specification for display serial interface and MIPI alliance specification for D-PHY.

The interface IF may include a transmission interface IF_TX included in the host processor 2000 and a reception interface IF_RX included in the display module 1000. The transmission interface IF_TX and the reception interface IF_RX may include PHYs corresponding to each other. In one embodiment, for example, the transmission interface IF_TX and the reception interface IF_RX may include one clock lane module and at least one data lane module.

Each of the lane modules corresponding to each other may communicate through channels Clkp, Clkn, D0*p* to D3*p*, and D0*n* to D3*n*. Each clock lane (or clock channel) may transmit, to the display module 1000, a MIPI clock having different frequency and different swing level from each other in response to an operation mode.

Each data lane (or data channel) may transmit, to the display module 1000, MIPI data (e.g., input image data IDATA) or first image data DATA1, which has different frequencies and different swing levels from each other in response to an operation mode.

In an embodiment, the interface IF may further include a first channel CH1 through which the scan frequency information SF_I is transferred to the display module 1000 (i.e., the display driving circuit 100) and a second channel CH2 through which the partial scan enable signal PS_EN is transferred to the display module 1000 (i.e., the display driving circuit 100). The interface IF may further include additional pins corresponding to the first channel CH1 and the second channel CH2.

However, this is merely illustrative, and at least one of the scan frequency information SF_I and the partial scan enable signal PS_EN may be added to a data packet including image data to be transferred through the data lane.

In an embodiment, in the video mode, the first image data DATA1 may be divided to be transferred through the interface IF during the transmission periods, and the transmission of the first image data DATA1 may be suspended during the suspend periods. Functions of power sources and control circuits for data transmission may be turned off in the suspend periods. Thus, the power consumption in the video mode in which low frequency driving is performed may be reduced.

Figure 4:
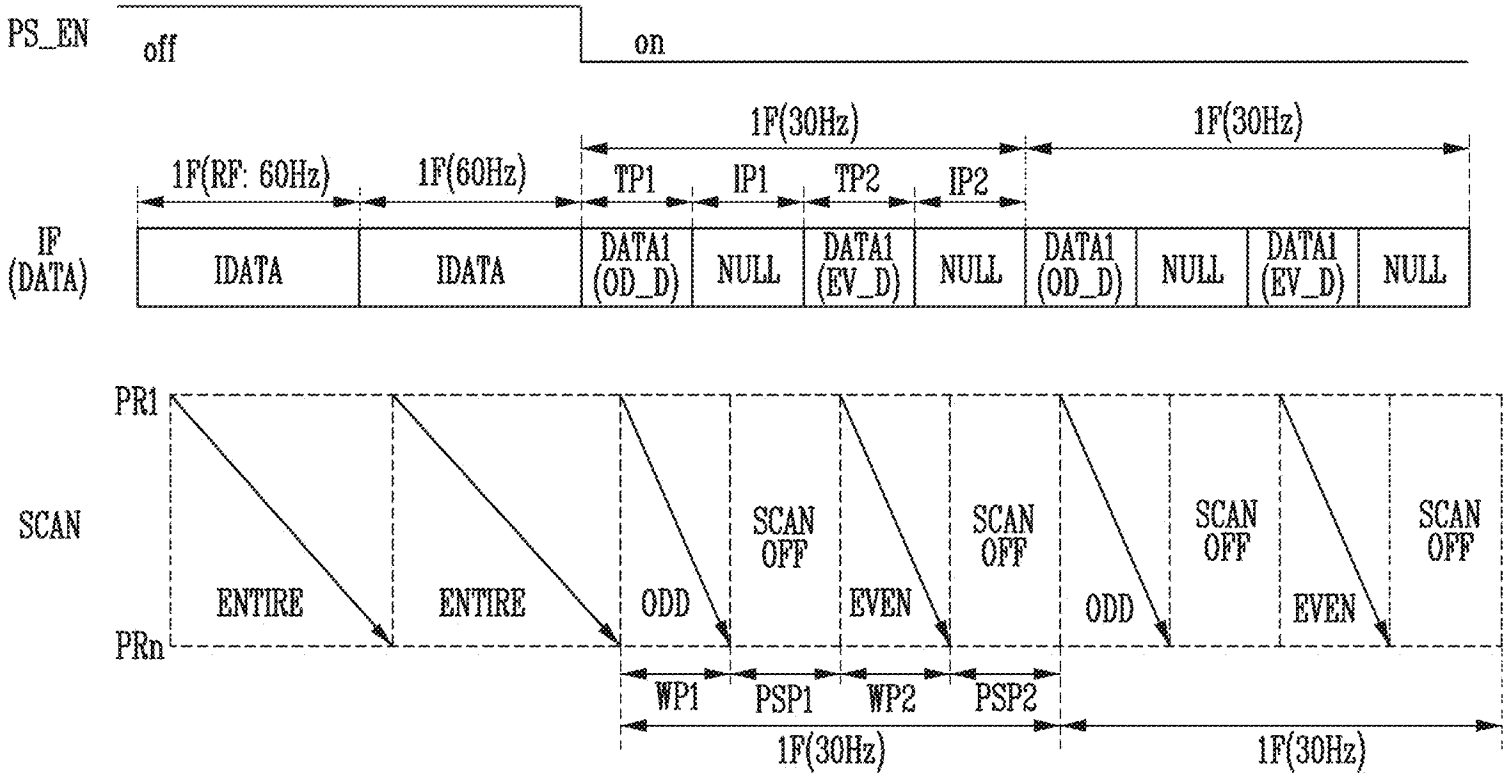
FIG. 4 is a diagram illustrating an embodiment of an operation of the display system shown in FIG. 1 in a video mode of the interface.

FIG. 4 is a diagram illustrating an embodiment of an operation of the display system shown in FIG. 1 in the video mode of the interface.

Referring to FIGS. 1, 2, and 4, in the video mode VM, an image driving frequency may be changed, and a scan driving method may be changed to correspond to the image driving frequency.

In an embodiment, as described above, in the video mode MV, data signals corresponding to image data DATA supplied from the host processor 2000 may be provided to the display panel 200 in real time. In such an embodiment, as shown in FIG. 4, a time delay caused by a time taken to perform data sampling, latching, or the like may exist between a time at which the image data DATA is transferred to the interface IF and a time at which data signals obtained by converting the image data DATA are provided to the display panel 200.

When the image driving frequency is 60 Hz, the partial scan enable signal PS_EN is not supplied or may have the turn-off level. Therefore, the partial scan controller 120 may be in an inactivation state. The host processor 2000 may provide input image data IDATA to the interface IF. That is, the input image data IDATA may include all image data from a first pixel of a first pixel row PR1 to a last pixel of an n-th pixel row PRn (i.e., a last pixel row).

The input image data IDATA transferred through the interface IF may be supplied to the data driver 160 through the controller 110. The scan driver 140 may supply a scan signal SCAN to the pixel rows (i.e., the scan lines S1 to Sn) by using a normal driving method. In one embodiment, for example, one frame 1F may be driven at 60 Hz, and the scan signal SCAN may be sequentially supplied to the first to n-th pixel rows PR1 to PRn.

In an embodiment, a reference frequency RF may be set as 60 Hz. When the image driving frequency is lower than 60 Hz, the partial scan enable signal PS_EN may be activated. In one embodiment, for example, as shown in FIG. 4, the image driving frequency may be set as about 30 Hz.

In an embodiment, the host processor 2000 may generate first image data DATA1 obtained by rearranging an output order of the input image data IDATA based on the image driving frequency and/or the partial scan enable signal PS_EN. In such an embodiment, the host processor 2000 may determine a plurality of transmission periods and a plurality of suspend periods based on the image driving frequency.

A number of times the transmission periods and the suspend periods are repeated may be determined by a relationship between the reference frequency RF and the image driving frequency. In an embodiment, as shown in FIG. 4, the image driving frequency corresponds to a half of the reference frequency, and therefore, a first transmission period TP1, a second transmission period TP2, a first suspend period IP1, and a second suspend period IP2 may be set. The transmission periods TP1 and TP2 and the suspend periods IP1 and IP2 may be set to progress alternately.

However, this is merely illustrative, and the number of times the transmission periods and the suspend periods are repeated may increase as the image driving frequency decreases. In one alternative embodiment, for example, the image driving frequency is 20 Hz, first to third transmission periods and first to third suspend periods may be set corresponding to one frame, and the first image data DATA1 may be transmitted throughout the first to third transmission periods.

The first image data DATA1 may be divided to correspond to the first transmission period TP1 and the second transmission period TP2. In an embodiment, in the first transmission period TP1, odd data OD_D as image data DATA corresponding to the odd-numbered pixel rows may be output in series. In the second transmission period TP2, even data EV_D as image data DATA corresponding to the even-numbered pixel rows may be output in series.

In the first and second suspend periods IP1 and IP2, the output of image data DATA and the transfer of image data DATA through the interface IF may be suspended. In the first and second suspend periods IP1 and IP2, functions of power sources and control circuits, which are used to output and transfer image data DATA may be turned off. Thus, the power consumption in the video mode may be reduced.

The partial scan controller 120 may control data writing, corresponding to the first and second transmission periods TP1 and TP2 and the first and second suspend periods IP1 and IP2. In one embodiment, for example, first and second write periods WP1 and WP2 corresponding to the first and second transmission periods TP1 and TP2 and first and second power saving periods PSP1 and PSP2 corresponding to the first and second suspend periods IP1 and IP2 may be set in one frame 1F. The write periods WP1 and WP2 and the power saving periods PSP1 and PSP2 may be set to progress alternately.

In the first write period WP1, data signals obtained by converting the odd data OD_D may be written to the odd-numbered pixel rows. That is, in the first write period WP1, a scan signal SCAN for data writing to the odd-numbered pixel rows may be sequentially supplied. As compared with the driving at 60 Hz, the number of pixel rows to which the scan signal SCAN is supplied decreases to a half, and therefore, a length of the first write period WP1 may correspond to about a half of the time for which the scan signal SCAN is supplied to all the pixel rows in the driving at 60 Hz.

In the second write period WP2, data signals obtained by converting the even data EV_D may be written to the even-numbered pixel rows. That is, a scan signal for data writing to the even-numbered pixel rows may be sequentially supplied.

A total time of the first write period WP1 and the second write period WP2 may be substantially equal to the scan time in the driving at 60 Hz.

An image of the odd-numbered pixel rows may be displayed in the first power saving period PSP1, and an image of the even-numbered pixel rows may be displayed in the second power saving period PSP2. The supply of the scan signal SCAN and the supply of the data signal may be suspended in the first power saving period PSP1 and the second power saving period PSP2. In the first power saving period PSP1 and the second power saving period PSP2, some functions of the controller 110, which are used to drive the scan driver 140 and the data driver 160, may also be inactivated.

In an embodiment, the supply of power sources S_VDD and D_VDD for driving of the scan driver 140 and the data driver 160 may be suspended in the first power saving period PSP1 and the second power saving period PSP2.

In an embodiment, when the image driving frequency is 30 Hz, each of the first write period WP1 and the second write period WP2 may be repeated at a frequency of 30 Hz.

In an embodiment, as described above, in partial scan driving in response to the activation of the partial scan controller 120, an image of one frame is displayed by using a plurality of write periods WP1 and WP2 and a plurality of power saving periods PSP1 and PSP2, so that the power consumption may be reduced. Accordingly, an image failure such as an image flicker according to low frequency driving may be minimized.

In such an embodiment, in the video mode, image data DATA is divided and transmitted through the interface during the transmission periods TP1 and TP2, corresponding to the partial scan driving, and the transmission of the image data DATA is suspended in the suspend periods IP1 and IP2. Thus, the functions of the power sources and the control circuits, which are used to output and transfer the image data DATA, are turned off in the suspend periods IP1 and IP2, such that the effect that the power consumption is reduced in the low frequency driving may be maximized.

Figure 5:
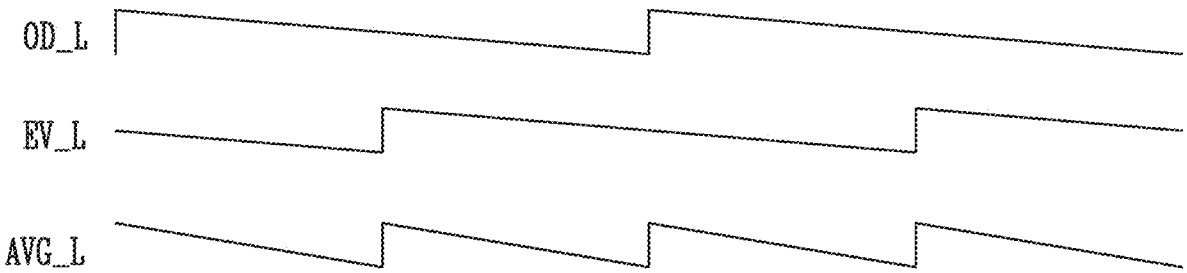
FIG. 5 is a diagram schematically illustrating a luminance change in driving at 30 Hz, shown in FIG. 4.

FIG. 5 is a diagram schematically illustrating a luminance change in the driving at 30 Hz, shown in FIG. 4.

Referring to FIGS. 4 and 5, a first luminance OD_L as a luminance of an odd-numbered pixel row and a second luminance EV_L as a luminance of an even-numbered pixel row may be differently detected by the partial scan driving.

A pixel may include a light emitting element in which light is emitted by a driving current. Leakage of the driving current may occur due to unique characteristics of transistors in the pixel. Therefore, when the light emitting element emits light after data writing, luminance may be decreased according to lapse of time due to the leakage of the driving current.

In an embodiment, as shown in FIG. 4, the first write period WP1 for the odd-numbered pixel rows and the second write period WP2 for the even-numbered pixel rows may be alternately repeated with frequency of 30 Hz.

Thus, each of the first luminance OD_L and the second luminance EV_L may be refreshed for every about 33.4 milliseconds (ms). Accordingly, an average luminance AVG_L as an average of the first luminance OD_L and the second luminance EV_L may exhibit a luminance change similar to that in the driving at 60 Hz.

In such an embodiment, the partial scan driving may minimize an image flicker that may occur as a side effect of the low frequency driving.

Figure 6:
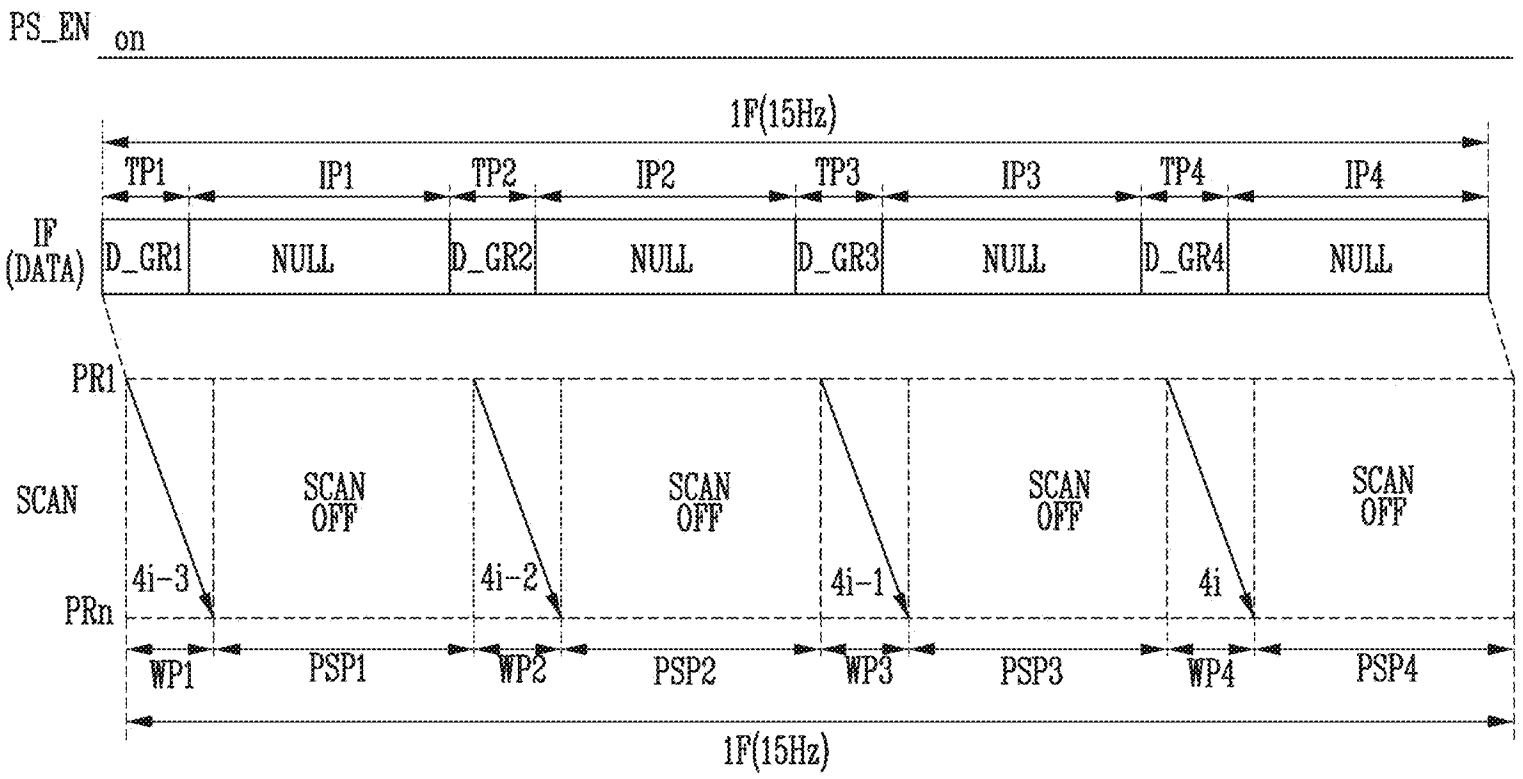
FIG. 6 is a diagram illustrating an alternative embodiment of the operation of the display system shown in FIG. 1 in the video mode of the interface.

FIG. 6 is a diagram illustrating an alternative embodiment of the operation of the display system shown in FIG. 1 in the video mode of the interface.

In FIG. 6, the same or like elements as those described above with reference to FIG. 4 are designated by the same or like reference numerals, and any repetitive detailed descriptions thereof will be omitted or simplified. FIG. 6 shows a case where the reference frequency RF is set as 60 Hz.

Referring to FIGS. 1, 2, 4, and 6, in the video mode VM, the partial scan driving may be performed at an image driving frequency of 15 Hz.

Since the image driving frequency corresponds to ¼ of the reference frequency, a transmission period may be divided into first to fourth transmission periods TP1 to TP4, and a suspend period may be divided into first to fourth suspend periods IP1 to IP4. The host processor 2000 may determine a number of transmission periods and suspend periods (i.e., a number of times the transmission periods and the suspend periods are repeated), based on a relationship between the image driving frequency and the reference frequency RF.

First image data DATA1 may be divided into first to fourth data groups D_GR1 to D_GR4 by the first to fourth transmission periods TP1 to TP4. In an embodiment, image data corresponding to four consecutive pixel rows may be respectively divided into the first to fourth data groups D_GR1 to D_GR4 to minimize an image flicker.

The first data group D_GR1 may include image data DATA corresponding to a (4i−3)-th (i is a natural number of n/4 or less) pixel row. The second data group D_GR2 may include image data DATA corresponding to a (4i−2)-th pixel row. The third data group D_GR3 may include image data DATA corresponding to a (4i−1)-th pixel row. The fourth data group D_GR4 may include image data DATA corresponding to a 4i-th pixel row.

The image data DATA of the first to fourth data groups D_GR1 to D_GR4 may be provided to the partial scan controller 120 through the interface IF respectively in the first to fourth transmission periods TP1 to TP4. The supply of the image data DATA may be suspended in the first to fourth suspend periods IP1 to IP4.

The partial scan controller 120 may control data writing, corresponding to the first to fourth transmission periods TP1 to TP4 and the first to fourth suspend periods IP1 to IP4. In one embodiment, for example, first to fourth write periods WP1 to WP4 and first to fourth power saving periods PSP1 to PSP4 may be set.

In an embodiment, a length of each of the first to fourth write periods WP1 to WP4 may correspond to about ¼ of the time for which the scan signal SCAN is supplied to all the pixel rows in the driving at 60 Hz. Accordingly, a length of each of the first to fourth power saving periods PSP1 to PSP4 may increase.

In an embodiment, as described above, the number of times write periods and power saving periods are repeated in one frame 1F may increase as the image driving frequency decreases. In such an embodiment, as the image driving frequency decreases, the length of each of the write periods WP1 to WP4 and the transmission periods TP1 to TP4 may decrease, and the length of each of the power saving periods PSP1 to PSP4 and the suspend periods IP1 to IP4 may increase.

Accordingly, in such an embodiment, the effect that the power consumption is reduced in the low frequency driving may be maximized.

Figure 7:
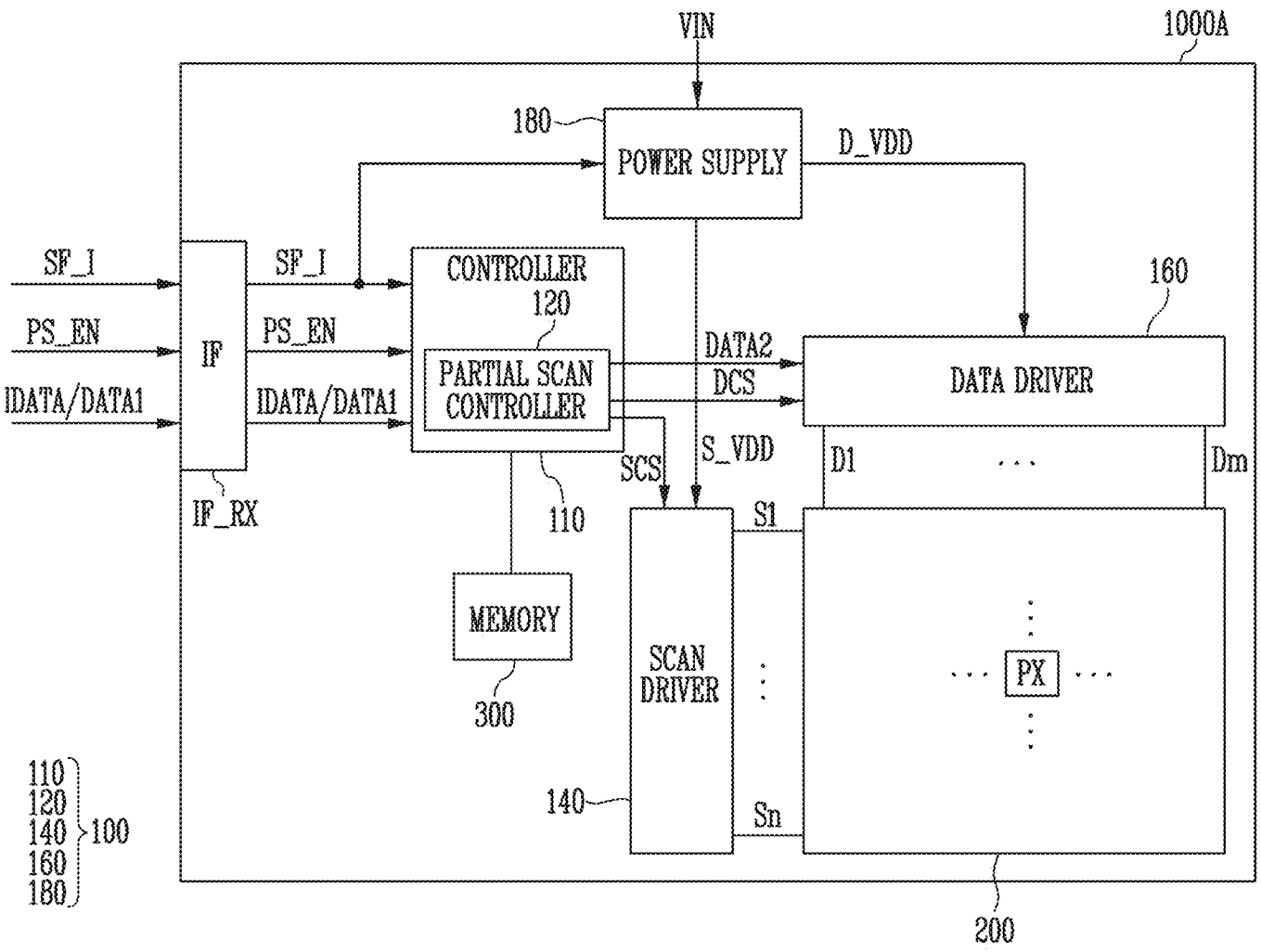
FIG. 7 is a block diagram illustrating an alternative embodiment of the display module included in the display system shown in FIG. 1.

FIG. 7 is a block diagram illustrating an alternative embodiment of the display module included in the display system shown in FIG. 1.

In FIG. 7, the same or like elements as those described above with reference to FIG. 2 are designated by the same or like reference numerals, and any repetitive detailed descriptions thereof will be omitted or simplified.

Referring to FIGS. 1 and 7, an embodiment of a display module 1000A may include a display driving circuit 100 and a display panel 200.

The display driving circuit 100 may include a partial scan controller 120, a scan driver 140, a data driver 160, and a power supply 180. In an embodiment, the display module 1000A may further include a memory 300.

The memory 300 may store first image data DATA1 or input image data IDATA in the command mode of the interface IF. In one embodiment, for example, the memory 300 may include a frame memory, and store first image data DATA1 or input image data IDATA of a predetermined frame.

In an embodiment, the memory 300 may be a nonvolatile memory. In one embodiment, for example, the memory 300 may be implemented as an erasable programmable read-only memory ("EPROM"), an electrically erasable programmable read-only memory ("EEPROM"), a flash memory, or the like.

In an embodiment, in the command mode of the interface IF, image data (i.e., first image data DATA1 or input image data IDATA) supplied from the host processor 2000 may be stored in the memory 300 in units of frames. In such an embodiment, in the command mode, whether the partial scan controller 120 is to be operated (activated) may be determined based on the partial scan enable signal PS_EN.

When the partial scan controller 120 is activated, the partial scan controller 120 may control the partial scan driving as power saving driving by loading the first image data DATA1 from the memory 300, based on the scan frequency information SF_I.

When the partial scan controller 120 is inactivated, the controller 110 may load the input image data IDATA from the memory 300, and perform normal scan driving and image display.

Figure 8:
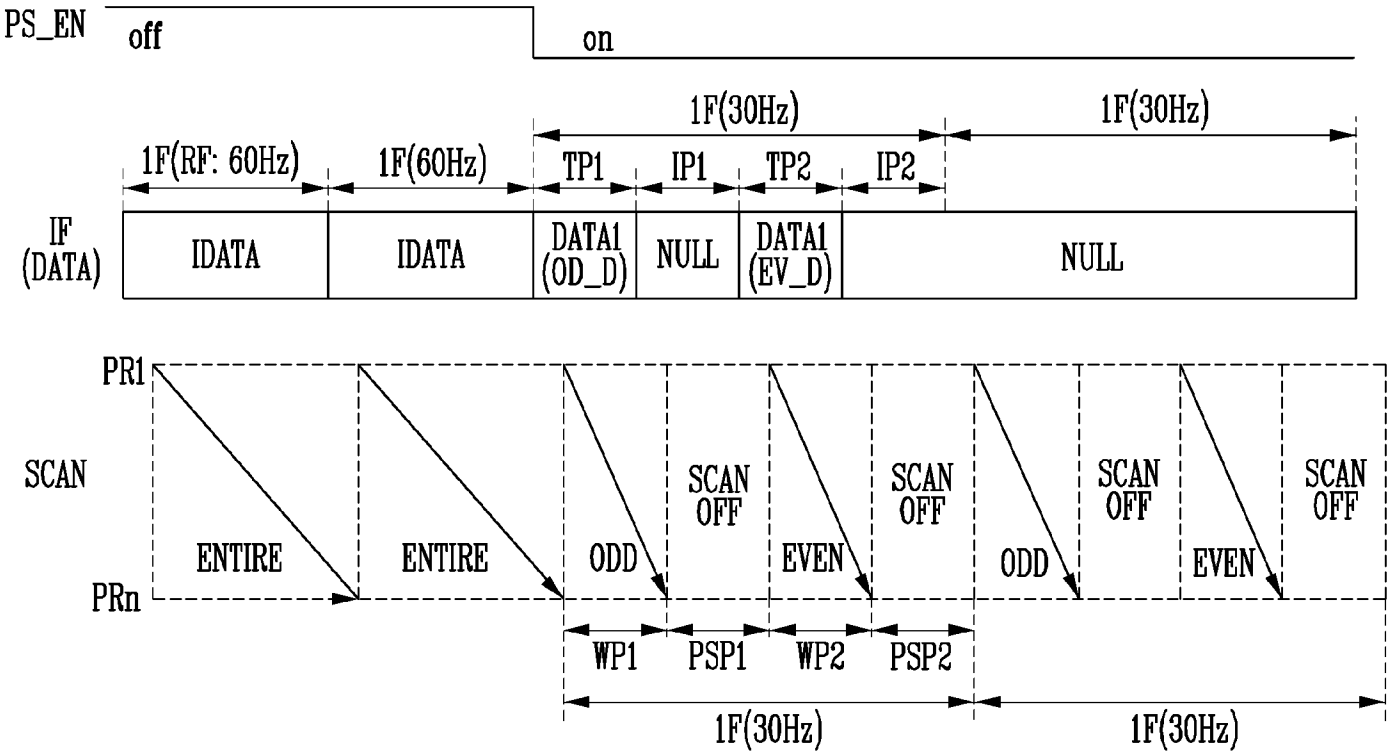
FIG. 8 is a diagram illustrating an embodiment of an operation of the display system shown in FIG. 1 in a command mode of the interface.

FIG. 8 is a diagram illustrating an embodiment of an operation of the display system shown in FIG. 1 in the command mode of the interface.

Figure 9:
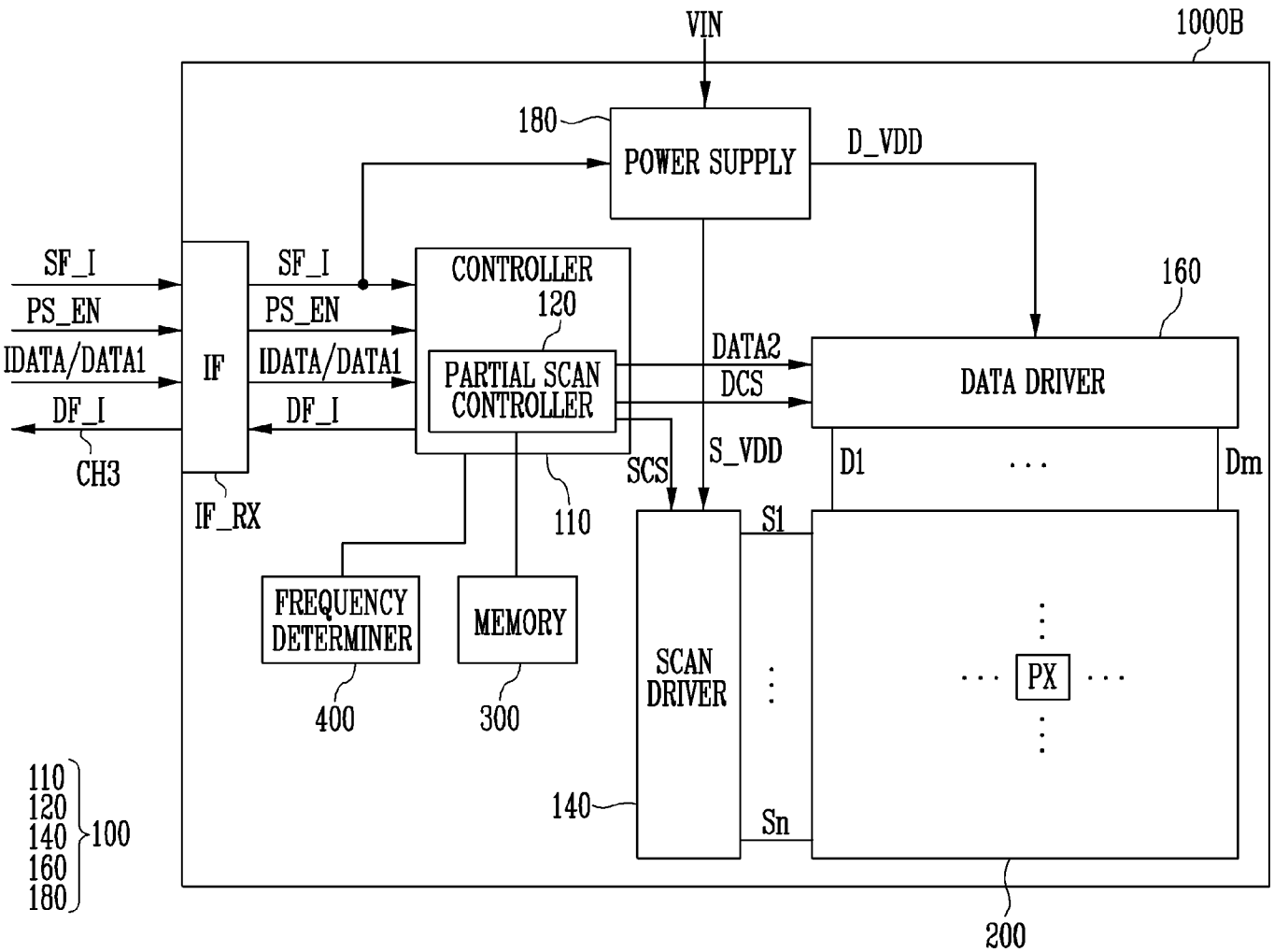
FIG. 9 is a block diagram illustrating an embodiment of the display module and the interface, which are included in the display system shown in FIG. 1.

In FIG. 8, to the same or like elements as those described above with reference to FIG. 4 are designated by the same or like reference numerals, and any repetitive detailed descriptions will be omitted or simplified. FIG. 9 shows a case where the reference frequency RF is set as 60 Hz.

Referring to FIGS. 1, 7, and 8, in the command mode CM, an image driving frequency may be changed, and a scan driving method may be changed to correspond to the image driving frequency.

When the image driving frequency is 60 Hz, the partial scan controller 120 may be in the inactivation state. The host processor 2000 may provide input image data IDATA to the interface IF. That is, the input image data IDATA may include all image data from the first pixel of the first pixel row PR1 to the last pixel of the n-th pixel row PRn (i.e., the last pixel row).

The input image data IDATA transferred through the interface IF may be stored in the memory 300. A controller 110 may load input image data IDATA stored in units of frames from the memory 300, and provide the loaded input image data to the data driver 160. The scan driver 140 may supply a scan signal SCAN to the pixel rows (i.e., scan lines S1 to Sn) by using a normal driving method.

When the image driving frequency is set as 30 Hz, the partial scan enable signal PS_EN may be activated. The host processor 2000 may generate first image data DATA1 obtained by rearranging an output order of the input image data IDATA based on the image driving frequency and/or the partial scan enable signal PS_EN. In this case, the host processor 2000 may determine a plurality of transmission periods and a plurality of suspend periods based on the image driving frequency.

In an embodiment, the display module 1000A may display a low power image such as a still image during a period in which the partial scan enable signal PS_EN is activated.

In an embodiment, in a partial scan activation period of the command mode in response to the activation of the partial scan enable signal PS_EN, the host processor 2000 may rearrange, as the first image data DATA1, input image data IDATA of a first frame according to entrance into the partial scan activation period. The host processor 2000 may divide (or distribute) the first image data DATA1 and then output the divided first image data through the interface IF during transmission periods TP1 and TP2 of the first frame (or entrance frame) of the partial scan activation period, based on the image driving frequency. In one embodiment, for example, odd data OD_D may be output in a first transmission period TP1, and even data EV_D may be output in a second transmission period TP2.

The host processor 2000 may suspend the output of the first image data DATA1 through the interface IF during suspend periods IP1 and IP2 of the first frame of the partial scan activation period.

The odd data OD_D and the even data EV_D may be stored in the memory 300. The partial scan controller 120 may load the odd data OD_D from the memory 300, corresponding to a first write period WP1, and load the even data EV_D from the memory 300, corresponding to a second write period WP2.

In the first write period WP1, data signals obtained by converting the odd data OD_D may be written to the odd-numbered pixel rows. In the second write period WP2, data signals obtained by converting the even data EV_D may be written to the even-numbered pixel rows.

An image of the odd-numbered pixel rows may be displayed in a first power saving period PSP1, and an image of the even-numbered pixel rows may be displayed in a second power saving period PSP2. The supply of the scan signal SCAN and the supply of the data signal may be suspended in the first power saving period PSP1 and the second power saving period PSP2. In the first power saving period PSP1 and the second power saving period PSP2, some functions of the controller 110, which are used to drive the scan driver 140 and the data driver 160, may also be inactivated. In an embodiment, the supply of power sources S_VDD and D_VDD for driving of the scan driver 140 and the data driver 160 may be suspended in the first power saving period PSP1 and the second power saving period PSP2.

In an embodiment, the host processor 2000 may suspend the output of image data DATA with respect to subsequent frames of the first frame of the partial scan activation period. In one embodiment, for example, when a still image is displayed during the partial scan activation period, an image may be displayed by using image data stored in the memory 300. Therefore, the transfer of image data DATA from the host processor 2000 may be omitted.

Accordingly, functions of various power sources and control circuits of the host processor 2000 and the interface IF, which are associated with the transfer of image data, are turned off during a period corresponding to the subsequent frames, and thus power consumption may be reduced.

In an embodiment, as described above, the display driving circuit 100 may be driven identically to the first frame of the partial scan activation period. In one embodiment, for example, the partial scan controller 120 may load a portion of the first image data DATA1 (e.g., the odd data OD_D or the even data EV_D) from the memory 300 and then provide the loaded portion of the first image data DATA1 to the data driver 160 for each of the write periods WP1 and WP2.

In such an embodiment, as described above, the functions of various power sources and control circuits of the host processor 2000 and the interface IF, which are associated with the transfer of image data, are turned off in subsequent frames of a first frame in which the same still image is displayed in the command mode CM of the interface IF, such that the power consumption may be further reduced.

FIG. 9 is a block diagram illustrating an embodiment of the display module and the interface, which are included in the display system shown in FIG. 1.

In FIG. 9, the same or like elements as those described above with reference to FIGS. 2 and 7 are designated by the same or like reference numerals, and any repetitive detailed descriptions thereof will be omitted or simplified.

Referring to FIGS. 1 and 9, an embodiment of a display module 1000B may include a display driving circuit 100 and a display panel 200.

The display driving circuit 100 may include a partial scan controller 120, a scan driver 140, a data driver 160, and a power supply 180. In an embodiment, the display module 1000B may further include a memory 300 and a frequency determiner 400.

In an embodiment, in the command mode, the frequency determiner 400 may determine an image driving frequency, based on input image data IDATA. In one embodiment, for example, the frequency determiner 400 may determine whether a still image is displayed, based on a result obtained by comparing input image data IDATA of consecutive frames with image data stored in the memory 300. However, this is merely illustrative, and the method of determining whether the still image is displayed is not limited thereto. The frequency determiner 400 may determine whether a current image is the still image by using various image analysis methods known in the art.

When it is determined that the current image is the still image, the frequency determiner 400 may determine the image driving frequency as a frequency (e.g., 30 Hz or lower) lower than the reference frequency. The frequency determiner 400 may provide a controller 110 with determined image driving frequency information DF_I. The image driving frequency information DF_I may be provided to the host processor 2000 through an interface IF.

The interface IF may further include pins and a channel CH3, through which the image driving frequency information DF_I is transferred from a reception interface IF_RX to the transmission interface (IF_TX shown in FIG. 3) of the host processor 2000.

The host processor 2000 may generate a partial scan enable signal PS_EN and scan frequency information SF_I, based on the image driving frequency information DF_I transferred from the interface IF. Also, the host processor 2000 may generate first image data DATA1, based on the scan frequency information SF_I.

In such an embodiment, as described above, the display module 1000*b* provides the image driving frequency information DF_I to the host processor 2000 in the command mode. Thus, the host processor 2000 may rearrange image data to correspond to the image driving frequency information DF_I and then provide the image data in only a period in which an image update is to be performed. Accordingly, the power consumption in the host processor 2000 may be further reduced.

In embodiments of the display system in accordance with the disclosure, an image of one frame is displayed by using a plurality of write periods and a plurality of power saving periods in partial scan driving in response to activation of the partial scan controller, such that power consumption can be reduced. In such embodiments, an image failure such as an image flicker due to low frequency driving may be minimized.

In such embodiments, in the video mode of the interface, image data is divided and transmitted through the interface during a plurality of transmission periods, corresponding to the partial scan driving, and the transmission of image data through the interface may be suspended in suspend periods. Thus, functions of various power sources and control circuits, which are used to output and transfer the image data may be turned off in the suspend periods, so that the effect that the power consumption of the display system is reduced in the low frequency driving may be maximized.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims.

What is claimed is:

1. A display system comprising:

a host processor which outputs first image data obtained by rearranging an output order of input image data and outputs scan frequency information and a partial scan enable signal, based on an image driving frequency;

a display module controlled by the host processor; and an interface through which data transmission between the host processor and the display module is performed, wherein the display module comprises:

a display driving circuit which generates data signals corresponding to the first image data, and controls a selection of pixel rows to which the data signals are supplied, based on the scan frequency information and the partial scan enable signal; and a display panel including pixels, wherein the display panel displays an image on selected pixel rows based on the data signals, and wherein, in a video mode of the interface, the host processor divides and outputs the first image data through the interface during transmission periods, based on the image driving frequency, and suspends an output of the first image data through the interface during suspend periods, and wherein the host processor outputs the partial scan enable signal when the image driving frequency is lower than a reference frequency.

2. The display system of claim 1, wherein the display driving circuit comprises:

a partial scan controller activated in response to the partial scan enable signal, wherein the partial scan controller generates a scan control signal and a data control signal based on the scan frequency information;

a scan driver which supplies a scan signal for data writing to corresponding pixel rows during each of write periods of one frame and suspends a supply of the scan signal during power saving periods of the one frame, based on the scan control signal; and a data driver which converts the first image data into the data signals, and supplies the data signals to data lines during the write periods.

3. The display system of claim 2, wherein the data driver suspends an output of the data signals during the power saving periods.

4. The display system of claim 3, wherein the display driving circuit further comprises:

a power supply which generates power sources supplied to the scan driver and the data driver, and wherein the power supply suspends a supply of at least one selected from the power sources during the power saving periods, based on the scan frequency information.

5. The display system of claim 2, wherein, the transmission periods corresponding to an image of the one frame include first to k-th, transmission periods, and the suspend periods corresponding to the image of the one frame include first to k-th suspend periods respectively adjacent to the first to k-th transmission periods, wherein k is an integer greater than 1, and wherein the host processor determines a value of k, based on the image driving frequency.

6. The display system of claim 5, wherein the write periods include first to k-th write periods respectively corresponding to the first to k-th transmission periods, and the power saving periods include first to k-th power saving periods respectively corresponding to the first to k-th suspend periods.

7. The display system of claim 6, wherein the scan driver supplies the scan signal to different pixel rows in the first to k-th write periods.

8. The display system of claim 7, wherein a number of repetitions of the write period and the power saving period in the one frame increases as the image driving frequency decreases.

9. The display system of claim 7, wherein, as the image driving frequency decreases, a length of each of the first to k-th write periods decreases and a length of each of the first to k-th power saving periods increases.

10. The display system of claim 5, wherein, as the image driving frequency decreases, a length of each of the first to k-th transmission periods decreases and a length of each of the first to k-th suspend periods increases.

11. The display system of claim 5, wherein the host processor divides the first image data corresponding to the image of the one frame into k data groups and then outputs the k data groups to the interface in the first to k-th transmission periods, respectively.

12. The display system of claim 1, wherein the image driving frequency is lower than the reference frequency in the video mode.

13. The display system of claim 12, wherein, in a partial scan activation period in which the partial scan enable signal of a command mode of the interface is activated, the host processor rearranges, as the first image data, the input image data of a first frame at a start timing of the partial scan activation period, divides and outputs the first image data through the interface during transmission periods of the first frame, based on the image driving frequency, and suspends the output of the first image data through the interface during suspend periods of the first frame.

14. The display system of claim 13, wherein the display module further comprises:

a memory which stores the first image data in the command mode.

15. The display system of claim 14, wherein, in the partial scan activation period of the command mode, the partial scan controller loads a portion of the first image data from the memory for every write period of subsequent frames of the first frame and provides the portion of the first image data to the data driver.

16. The display system of claim 15, wherein the host processor suspends the output of image data corresponding to the subsequent frames in the partial scan activation period.

17. The display system of claim 15, wherein the display module further comprises:

a frequency determiner which determines an image driving frequency based on the input image data, and provides information of the image driving frequency to the host processor through the interface.

18. The display system of claim 2, wherein the interface includes a display serial interface, and wherein the display serial interface comprises:

a first channel which transfers the scan frequency information to the display driving circuit; and a second cannel which transfers the partial scan enable signal for activating the partial scan controller to the display driving circuit.

19. A display device comprising:

an interface which receives divided image data of one frame from an external device during transmission periods apart from each other in time, based on an image driving frequency in a video mode;

a display driving circuit which generates data signals corresponding to the divided image data, and controls a selection of pixel rows to which the data signals are supplied, based on scan frequency information and a partial scan enable signal; and a display panel including pixels, wherein the display panel displays an image on selected pixel rows based on the data signals, wherein the display driving circuit comprises:

a partial scan controller activated in response to the partial scan enable signal, wherein the partial scan controller generates a scan control signal and a data control signal, based on the scan frequency information;

a scan driver which supplies a scan signal for data writing to corresponding pixel rows during each of write periods of the one frame and suspends a supply of the scan signal during power saving periods of the one frame, based on the scan control signal; and a data driver which converts the divided image data into the data signals, supplies the data signals to data lines during the write periods, and suspends an output of the data signals during the power saving periods, wherein the partial scan controller is configured to be activated in response to the partial scan enable signal input thereto when the image driving frequency is lower than a reference frequency.

* * * * *